US011147386B2

(12) United States Patent
Hurdel

(10) Patent No.: US 11,147,386 B2
(45) Date of Patent: Oct. 19, 2021

(54) MODULAR HIDDEN BED CABINET

(71) Applicant: John M Hurdel, Hygiene, CO (US)

(72) Inventor: John M Hurdel, Hygiene, CO (US)

( * ) Notice: Subject to any disclaimer, the term of this patent is extended or adjusted under 35 U.S.C. 154(b) by 272 days.

(21) Appl. No.: 15/998,129

(22) Filed: Jul. 6, 2018

(65) Prior Publication Data

US 2019/0082853 A1 Mar. 21, 2019

Related U.S. Application Data

(63) Continuation-in-part of application No. PCT/US2016/000005, filed on Jan. 6, 2016.

(51) Int. Cl.

| | |
|---|---|
| ***A47C 17/54*** | (2006.01) |
| ***A47C 19/22*** | (2006.01) |
| ***A47C 17/60*** | (2006.01) |
| ***A47B 83/04*** | (2006.01) |

(52) U.S. Cl.

CPC ..... *A47C 17/54* (2013.01); *A47B 83/04* (2013.01); *A47C 17/60* (2013.01); *A47C 19/22* (2013.01)

(58) Field of Classification Search

CPC ..... A47C 17/54; A47C 17/60; A47C 19/22; A47C 17/52; A47C 17/46; A47C 17/38; A47C 17/48; A47C 17/16; A47B 83/04; A47B 19/08; A47B 46/00; A47B 46/005; A47B 83/001; A47B 85/06

USPC ..... 5/2.1

See application file for complete search history.

(56) References Cited

U.S. PATENT DOCUMENTS

| | | | | | |
|---|---|---|---|---|---|
| 63,065 | A | * | 3/1867 | Maine | A47C 17/40 5/164.1 |
| 119,312 | A | * | 9/1871 | Burr | A47C 19/22 5/2.1 |
| 201,337 | A | * | 3/1878 | Fay | A47C 19/22 5/2.1 |
| 219,078 | A | | 9/1879 | Dupre | |
| 249,431 | A | * | 11/1881 | Wheeler | A47C 17/32 5/313.1 |
| 251,113 | A | * | 12/1881 | Hall et al. | A47C 19/22 5/2.1 |
| 258,059 | A | * | 5/1882 | Hallheimer | A47C 17/58 5/158 |
| 260,346 | A | * | 6/1882 | Zimmerman | A47C 17/40 5/166.1 |
| 307,013 | A | * | 10/1884 | Carleton | A47C 19/022 5/53.2 |
| 310,343 | A | * | 1/1885 | Warren | A47C 19/122 5/152 |
| 314,032 | A | | 3/1885 | Laskey | |
| 340,858 | A | * | 4/1886 | Brown | A47C 17/40 5/164.1 |
| 357,530 | A | * | 2/1887 | Krause | A47C 17/165 5/43 |
| 379,449 | A | * | 3/1888 | Condell | A47C 17/40 5/164.1 |

(Continued)

*Primary Examiner* — Nicholas F Polito
*Assistant Examiner* — Luke Hall

(57) ABSTRACT

A combination bed construction comprising a bed frame, movable between a vertical and horizontal position, in which the bed frame has a pair of elongated boards on each end that extend over to a floor cabinet and engage pivots on each end of the floor cabinet, that when rotated to a vertical position on the pivots, the bed frame comes to rest on top of the cabinet.

6 Claims, 15 Drawing Sheets

(56) References Cited

Figure 1:
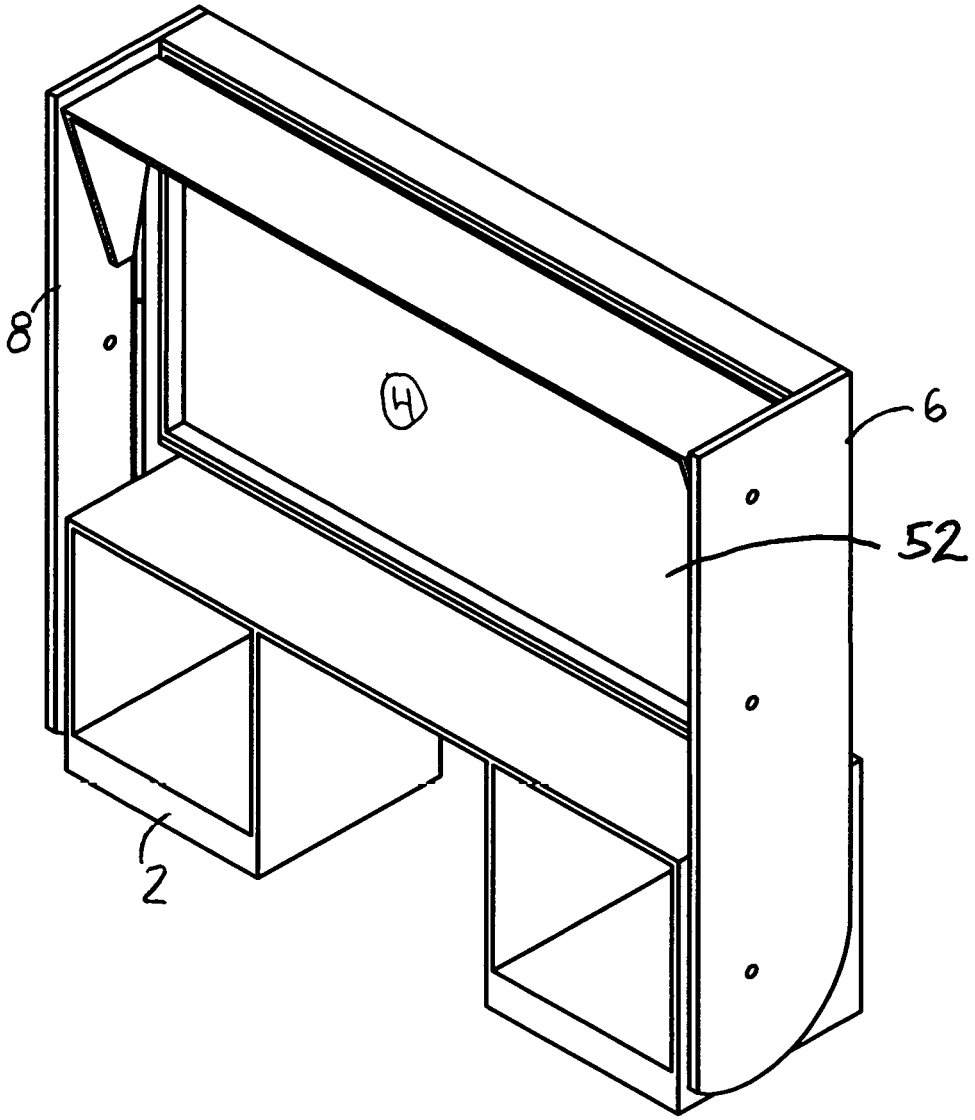

U.S. PATENT DOCUMENTS 403,850 A * 5/1889 Merrill ..... A47C 17/165 5/43
441,590 A * 11/1890 Skinner ..... A47C 19/22 5/2.1
449,892 A * 4/1891 Anderson ..... A47C 19/22 5/2.1
479,078 A * 7/1892 Purcell et al. ..... A47C 19/22 5/2.1
481,385 A * 8/1892 Barger ..... A47C 17/62 5/2.1
485,494 A * 11/1892 Eva ..... A47C 29/006 5/415
506,662 A * 10/1893 Blackmer ..... A47C 19/22 5/2.1
517,357 A * 3/1894 Murphy ..... A47C 17/40 5/137
517,458 A * 4/1894 Hopkins ..... A47C 19/22 5/2.1
529,944 A * 11/1894 Opel ..... A47C 17/40 5/164.1
597,591 A * 1/1898 Rhoads ..... A47C 17/86 5/308
809,710 A * 1/1906 Lui ..... A47C 19/22 5/2.1
815,400 A * 3/1906 Blose ..... A47C 4/10 5/315.2
892,348 A 6/1908 Baigne
925,397 A * 6/1909 Snyder ..... A47B 5/04 108/37
950,362 A * 2/1910 Anderson ..... A47C 17/40 5/166.1
1,094,526 A * 4/1914 Butterworth ..... A47C 17/40 5/133
1,105,203 A * 7/1914 La Vanway ..... A47C 17/40 5/145
1,121,636 A * 12/1914 Kreczkowski ..... A47C 19/22 5/2.1
1,336,240 A * 4/1920 Knight ..... A47D 7/007 5/2.1
1,346,896 A * 7/1920 Juszczak ..... A47C 17/54 5/160
1,359,337 A * 11/1920 Culbertson ..... A47C 17/46 5/133
1,400,534 A 12/1921 Ernest
1,419,586 A * 6/1922 Plackard ..... A47C 17/46 5/2.1
1,448,788 A * 3/1923 Campbell ..... A47B 83/045 312/291
1,567,258 A * 12/1925 Galik ..... A47C 17/54 5/2.1
1,893,526 A 2/1929 Shriver
1,800,610 A * 4/1931 Edwards ..... A47C 17/44 5/2.1
2,193,352 A * 3/1940 Thomas ..... B60P 3/34 296/162
2,223,958 A * 12/1940 Laursen ..... A47C 9/06 248/240.1
2,224,727 A * 12/1940 Friede ..... A47C 17/46 5/9.1
2,257,625 A * 9/1941 Thomas ..... A47C 17/52 5/2.1
2,316,681 A * 4/1943 Ferrier ..... A47C 17/40 5/143
2,333,483 A * 11/1943 Marzillier ..... A47B 85/08 5/2.1
2,356,321 A * 8/1944 Irick ..... A47C 17/60 5/152
D157,781 S * 3/1950 Pahlmann ..... D6/664
2,503,675 A * 4/1950 Lunbeck ..... A47C 17/46 5/136
2,574,425 A * 11/1951 Thompson ..... A47B 83/04 108/1
2,577,741 A * 12/1951 Creveling ..... A47C 13/00 297/109
2,671,230 A * 3/1954 Potter ..... A47C 17/40 5/141
2,683,883 A * 7/1954 Hirst ..... A47C 17/52 5/140
2,822,229 A 8/1954 Carlson
2,711,544 A * 6/1955 Bystrom ..... A47D 7/007 5/2.1
2,724,128 A * 11/1955 Schulz ..... A47C 17/50 5/135
2,747,202 A * 5/1956 Driver ..... A47C 17/46 5/2.1
RE24,457 E * 4/1958 Hopeman, Jr. et al. ..... A47C 17/50 5/9.1
3,046,572 A * 7/1962 Eames ..... A47C 17/46 5/136
3,088,127 A * 5/1963 Eames ..... A47C 17/46 5/2.1
3,235,888 A * 2/1966 Nystrom ..... A47C 17/46 5/2.1
3,436,768 A * 4/1969 Dauwalder ..... A47B 49/004 5/2.1
3,537,769 A * 11/1970 Di Carlo ..... A47B 83/045 312/277
3,558,180 A * 1/1971 Algire ..... B60N 2/32 296/174
3,703,324 A * 11/1972 Smith ..... A47B 46/005 312/279
4,070,715 A * 1/1978 Reppas ..... A47C 17/52 5/2.1
4,483,027 A * 11/1984 Cowell ..... A47C 19/20 5/136
4,694,518 A * 9/1987 Lukich ..... A47C 17/52 312/237
4,829,610 A * 5/1989 Gonzalez-Alvarez ..... A47C 17/38 182/34
5,033,134 A 7/1991 Burchett
5,101,523 A * 4/1992 Bright ..... A47C 17/38 108/39
5,353,452 A * 10/1994 Rulis ..... A47C 17/40 5/136
5,522,102 A * 6/1996 Vayda ..... A47C 17/38 5/133
5,621,930 A * 4/1997 Reppas ..... A47C 17/04 5/136
6,212,710 B1 * 4/2001 Jones ..... B60P 3/38 296/170
6,401,276 B1 * 6/2002 Sherman ..... A47B 5/06 5/133
6,508,526 B2 * 1/2003 Reppas ..... A47B 21/0073 312/223.3
6,574,807 B1 * 6/2003 Gonzalez ..... A47C 17/58 5/149
6,779,208 B2 * 8/2004 Lim ..... A47C 17/20 5/136
6,929,321 B1 * 8/2005 Shrock ..... A47C 17/80 297/1
7,017,201 B2 * 3/2006 Lin ..... A47C 17/62 5/2.1
7,140,052 B2 11/2006 Monestier
7,487,564 B2 * 2/2009 Miller ..... A47C 17/40 5/1
7,921,487 B2 * 4/2011 Stonier ..... A47C 17/46 5/136
8,407,830 B1 * 4/2013 Kumar ..... A47C 17/54 312/240
8,898,831 B1 * 12/2014 Burchett ..... A47C 17/52 5/136
2001/0044960 A1 * 11/2001 Schwalbe, Jr. ..... A47C 17/40 5/136
2002/0027403 A1 * 3/2002 Vasudeva ..... A47B 46/005 312/244

(56) References Cited

U.S. PATENT DOCUMENTS

2002/0195907 A1* 12/2002 Lawson ..... A47D 5/00 312/198
2005/0055770 A1* 3/2005 Reppas ..... A47C 17/62 5/136
2005/0229307 A1* 10/2005 Monestier ..... A47C 17/62 5/3
2006/0021135 A1* 2/2006 Harvey ..... A47D 7/007 5/93.2
2006/0031986 A1* 2/2006 Revels ..... A47C 17/38 5/136
2006/0230530 A1* 10/2006 Avishay ..... A47C 17/48 5/136
2008/0229497 A1* 9/2008 Paoutoff ..... A47C 17/42 5/136
2008/0236452 A1* 10/2008 Pratt ..... A47B 85/00 108/13
2009/0064409 A1* 3/2009 Carpenter ..... A47D 11/005 5/2.1
2010/0043142 A1* 2/2010 Whitford ..... A47C 17/46 5/136
2011/0023230 A1* 2/2011 Colombo ..... A47C 17/38 5/43
2011/0088163 A1* 4/2011 Luft-Weissberg ..... A47C 17/52 5/2.1
2011/0145990 A1* 6/2011 Yoon ..... A47B 83/04 5/3
2011/0297052 A1* 12/2011 Martin ..... A47B 13/021 108/27
2012/0308299 A1* 12/2012 Pallot ..... A47C 7/002 403/322.4
2013/0014675 A1* 1/2013 Burkhalter ..... A47B 7/02 108/50.11
2013/0257234 A1* 10/2013 Kumar ..... A47C 17/54 312/7.2
2014/0237717 A1* 8/2014 Wong ..... A47C 17/165 5/2.1
2014/0310873 A1* 10/2014 Gosling ..... A47C 9/06 5/136
2015/0067963 A1* 3/2015 Grimoldi ..... A47C 17/165 5/37.1
2015/0145393 A1* 5/2015 Young ..... A47B 46/005 312/246
2016/0058196 A1* 3/2016 Grubb ..... A47C 17/54 5/159.1
2016/0074698 A1* 3/2016 Figueroa ..... A47C 17/86 5/2.1
2016/0084000 A1* 3/2016 Schlanker ..... E06B 9/115 5/136
2016/0242556 A1* 8/2016 Ray ..... A47B 83/00
2016/0324326 A1* 11/2016 McCoy ..... A47C 17/46

* cited by examiner

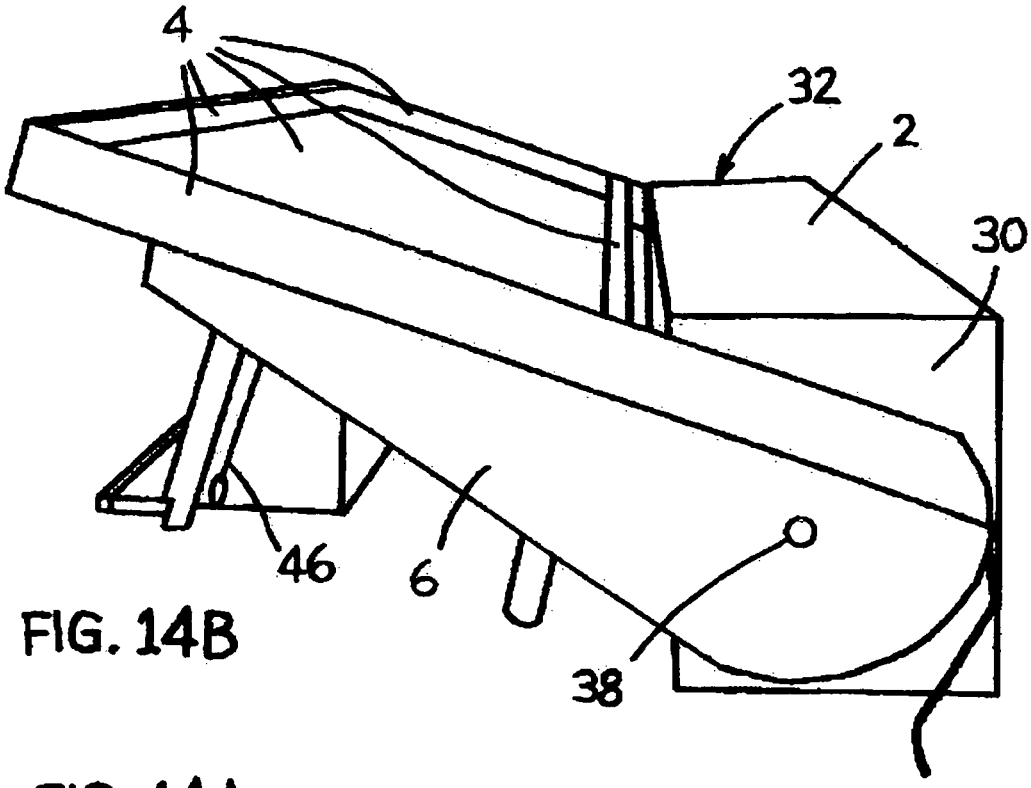
FIG. 14B
FIG. 14A
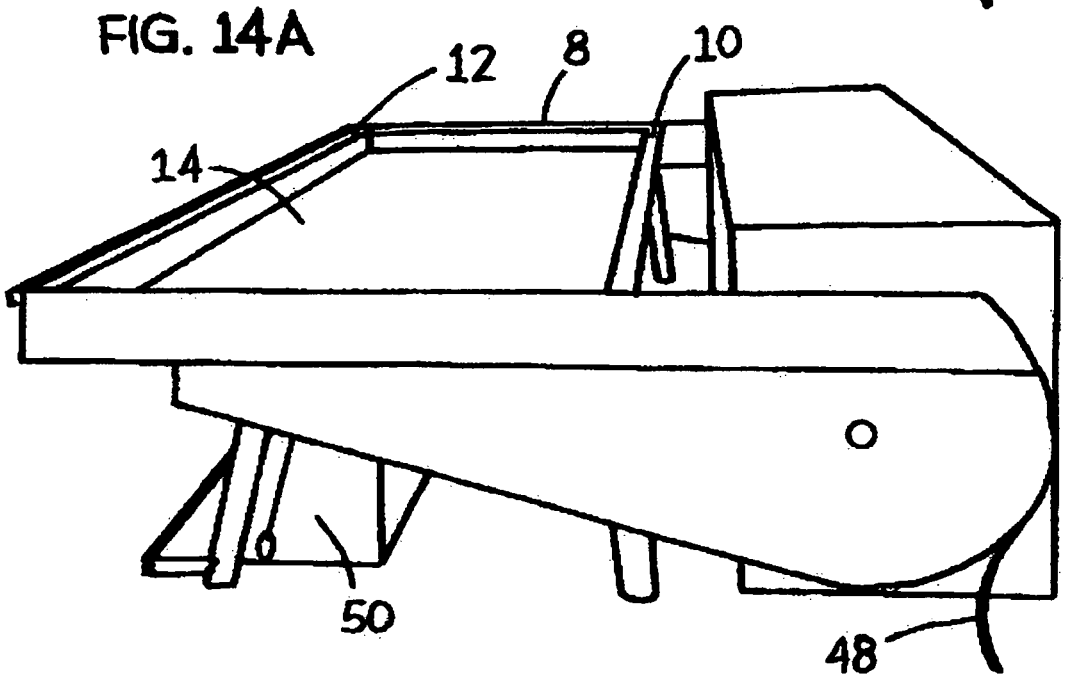

MODULAR HIDDEN BED CABINET

CROSS-REFERENCE TO RELATED APPLICATIONS

This is a Continuation-in-part of International Application PCT/US2016/000005 filed on Jan. 6, 2016 by the present inventor, which is incorporated by reference.

BACKGROUND

Related Art

In these days of overpopulated cities and increasingly smaller living and work spaces, the movement toward multipurpose furniture and spatial economy, without sacrificing floor space, has become more and more prevalent. Well over a century of inventors have tried to design the perfect hidden bed and many have made considerable inroads. There have been dozens, if not hundreds, of hidden beds that have been patented over the years.

It has been suggested that William L. Murphy hid a bed in a closet because in the late 19th Century it was uncouth to entertain a lady with a bed in the room. A century ago he was known more for a bed that lifted and spun into a closet, rather than the wardrobe type of hidden bed to which we associate his name.

The wardrobe style of hidden bed is likely the most common variety and they date well before Murphy was born. The main characteristics of these designs are a wall-mounted exterior frame which receives the bed and is pivotally attached to the bed. The bottom of the bed is designed to look like a cabinet, so when closed, appears to be a wardrobe or other piece of furniture.

In 1879, when Murphy was a toddler, a man in Boston named Dupre, offered a wardrobe style bed (US219078). Like many of that era it was fixed pivot and overcame its counterbalance issue with weights and pulleys. In 1885, Laskey offered the Mantel Bed (US314032). It was unique in that its fixed pivot was more centrally located to give it a mechanical advantage and on the rearward sides of the bed, projections followed tracks which steered it into its frame. Oliva Baigne's design of 1908 (US892348), used a fixed pivot and a torsion spring to lift his bed. In recent years, the mechanical advantage of choice has been the piston as Burchett showed in 1991 (U.S. Pat. No. 5,033,134).

In order to offer more functionality than just a bed, some creators added peripherals like abutting bookcases and shelves. Potter, (U.S. Pat. No. 2,671,230) in 1954, added a hinged panel to the face of his wardrobe bed to be used as a desktop and some magazine racks. It was a nice attempt toward functionality but you had to clear the desk to use the bed. A slight improvement to this were devices that had shelves or desktops which lowered to the floor by way of linkage, as the bed was rotated to its horizontal, extended position. Some such devices were offered in 2013 by Huanguang (CN203088189), and in 2014 by Darong (CN203646799), and Fuxiao (CN203987048). These shelves do not appear to be very well designed, but they will carry items to the floor.

Of course, not all of the hidden bed inventors designed wardrobes with false facades. Two examples actually appear to be desks at first glance. Monestier (U.S. Pat. No. 7,140,052) in 2006, and Xingbiao (CN203137689) in 2013, offered these designs. They used pivots and linkage to lower their devices beds as their desktops dropped to the floor. And then Martens' (CA2484910) bedframe was mounted inside a wallbox with linkage that looked like some components would break during rotation. Another desk/bed was by Reppas (U.S. Pat. No. 4,070,715) in 1978. It was an oversized device with a large amount of space dedicated to its mechanics. Ernest (U.S. Pat. No. 1,400,534) in 1921, and Thomas (U.S. Pat. No. 2,257,625) in 1941 each offered hidden bed cabinets with extra storage. Ernests self-leveling effect was largely due to suspension of his cabinets from a top center point and allowing gravity to take over. One of these cabinets was fitted with a slanted bottom, depreciating its usability, in order for it to clear the other one during rotation. Thomas' unit also had several upper cabinets. They also had angled floors which would induce their contents to fall out once you opened the door. Thomas' cabinets were hinged to the bottom of the bed and used parallel linkage for self-leveling similar to the trays of a tackle box as Shriver (U.S. Pat. No. 1,893,526) showed in 1929. Another good example of this parallel linkage system is with Gao in 2011 (CN201700827).

As far as counterbalance goes, there are many ways to overcome it. The previously cited designers and others have offered weights and pulleys, cables, springs, torsion springs, helical springs, pistons, gravity, and brute force. Stoniers 2005 (U.S. Pat. No. 7,921,487) discloses variable tensioning spring device as a sample of one of the better counterbalance mechanisms. It is fitted with up to 9 springs depending on what size of load you need to lift and holds the load at midpoints along the way.

The related art has various disadvantages. When it comes to world congestion and tiny spaces, furniture is going to trend toward multifunctionality. A place to sleep and a desk as a separate function would be desirable and the prior art solutions cited above require dead space in order to function properly. It is desirable to provide a hidden bed that includes storage, which may not have been successfully addressed in the prior art.

DRAWINGS—FIGURES

FIG. 1 isometric view of small bed design with leg only, knee hole base.

Figure 2:
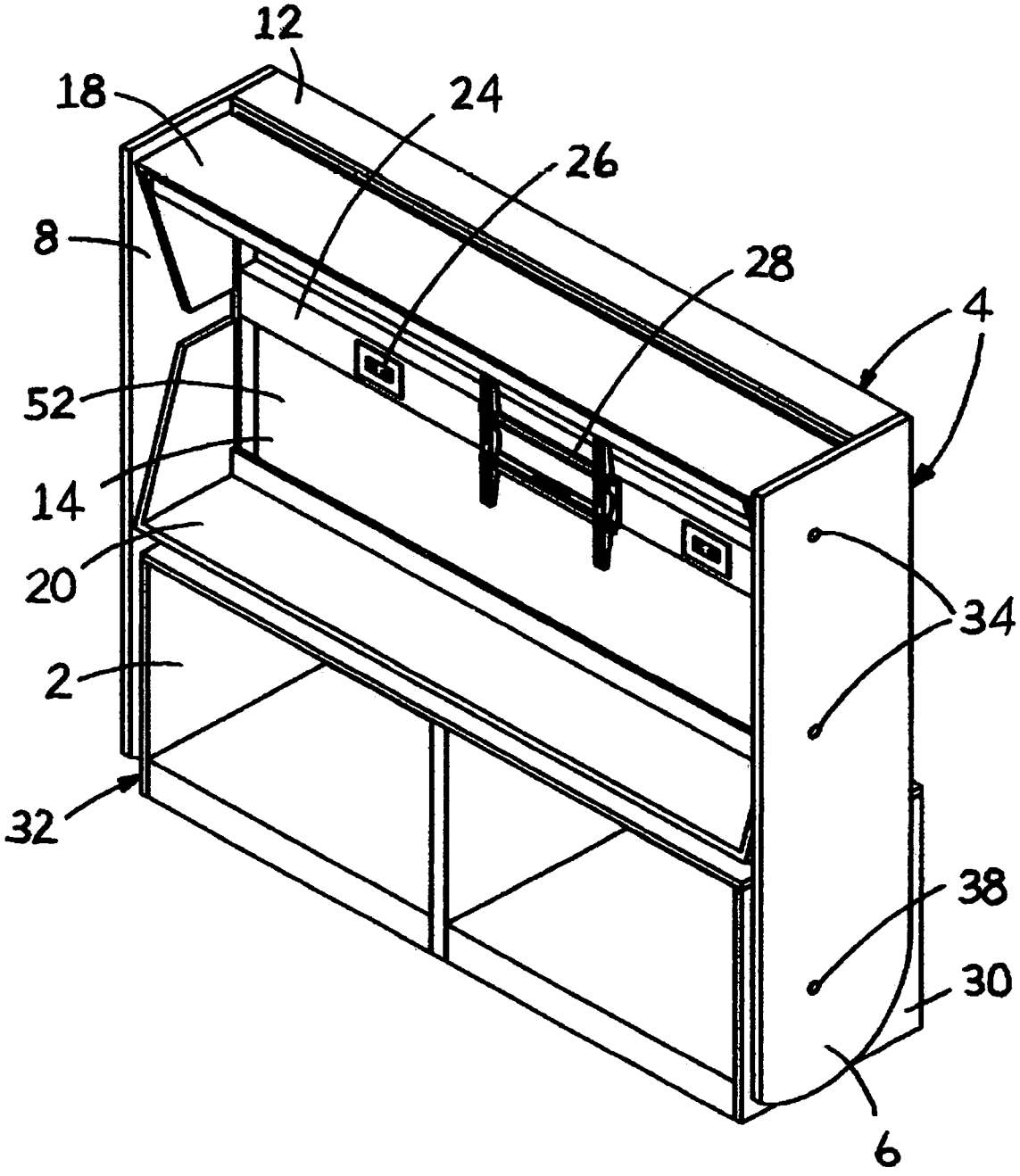

FIG. 2 isometric view of small bed design with valance type leg module, outlet support bar, monitor/tv mount, shelf module.

Figures 3A, 3B, 3C:
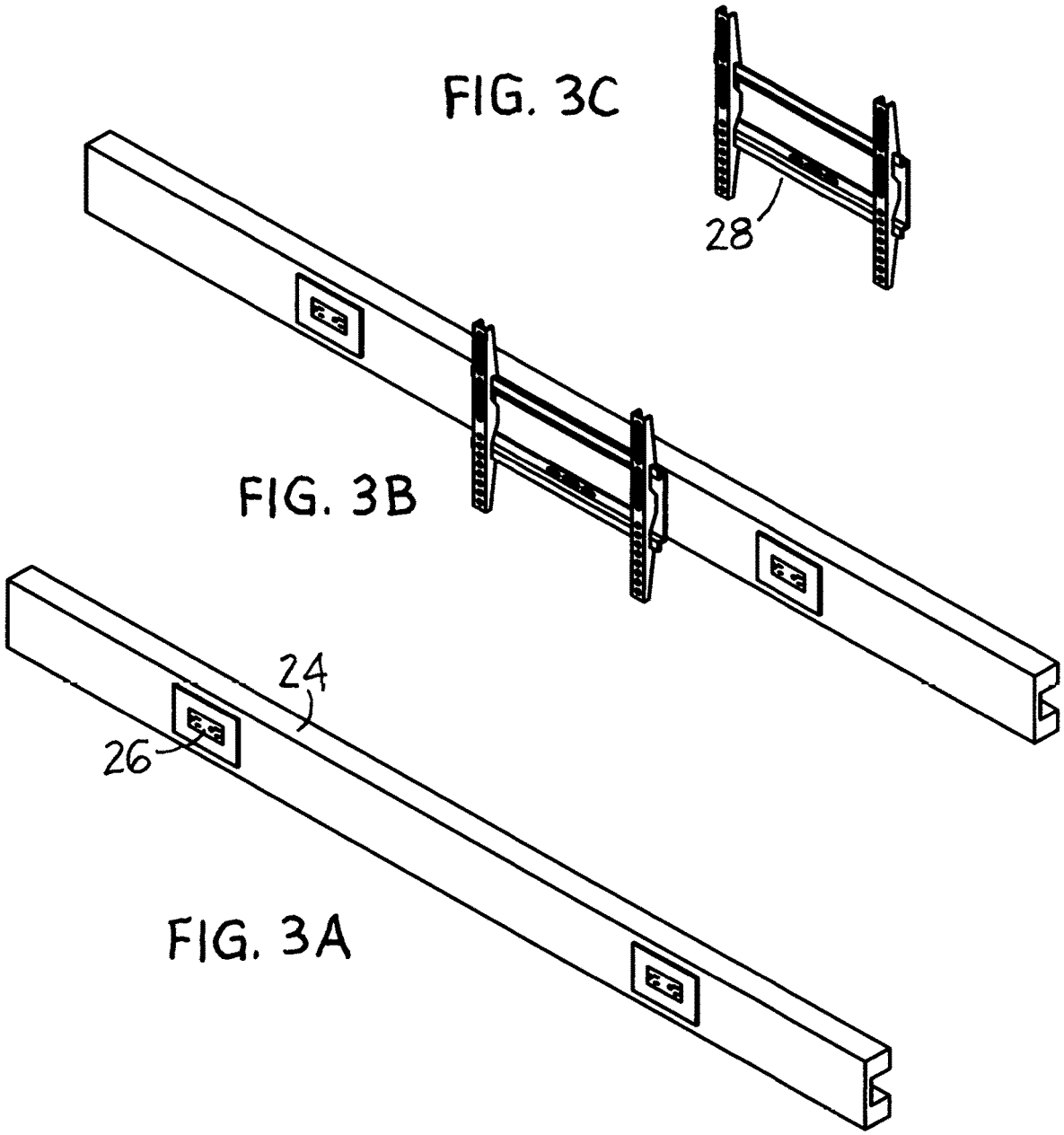

FIG. 3A isometric view of outlet support bar.

FIG. 3B isometric view of outlet support bar, monitor/tv mount.

FIG. 3C isometric view of monitor/tv mount.

Figure 4:
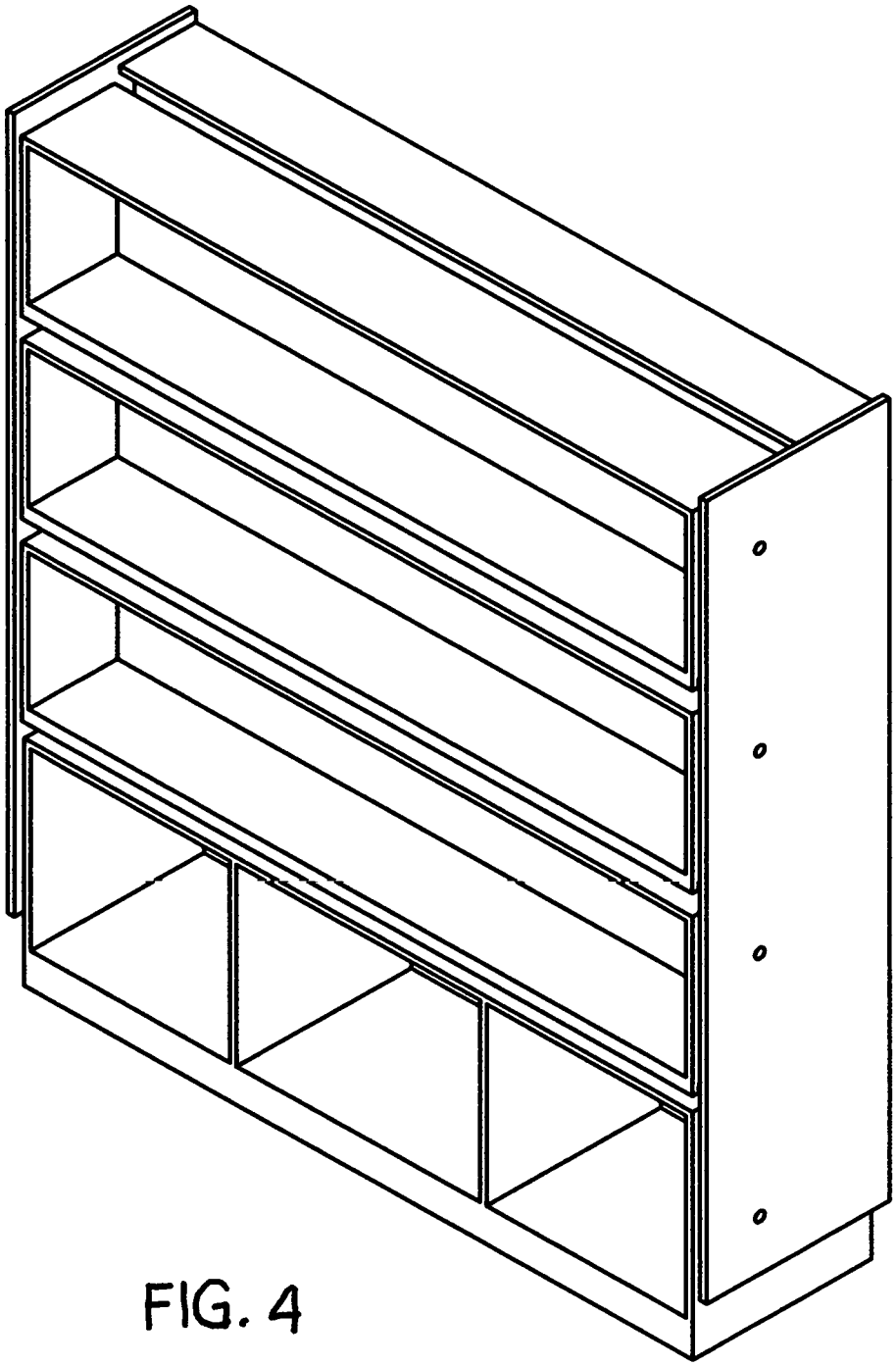

FIG. 4 isometric view of large bed design with 3 upper cabinet modules.

Figure 5:
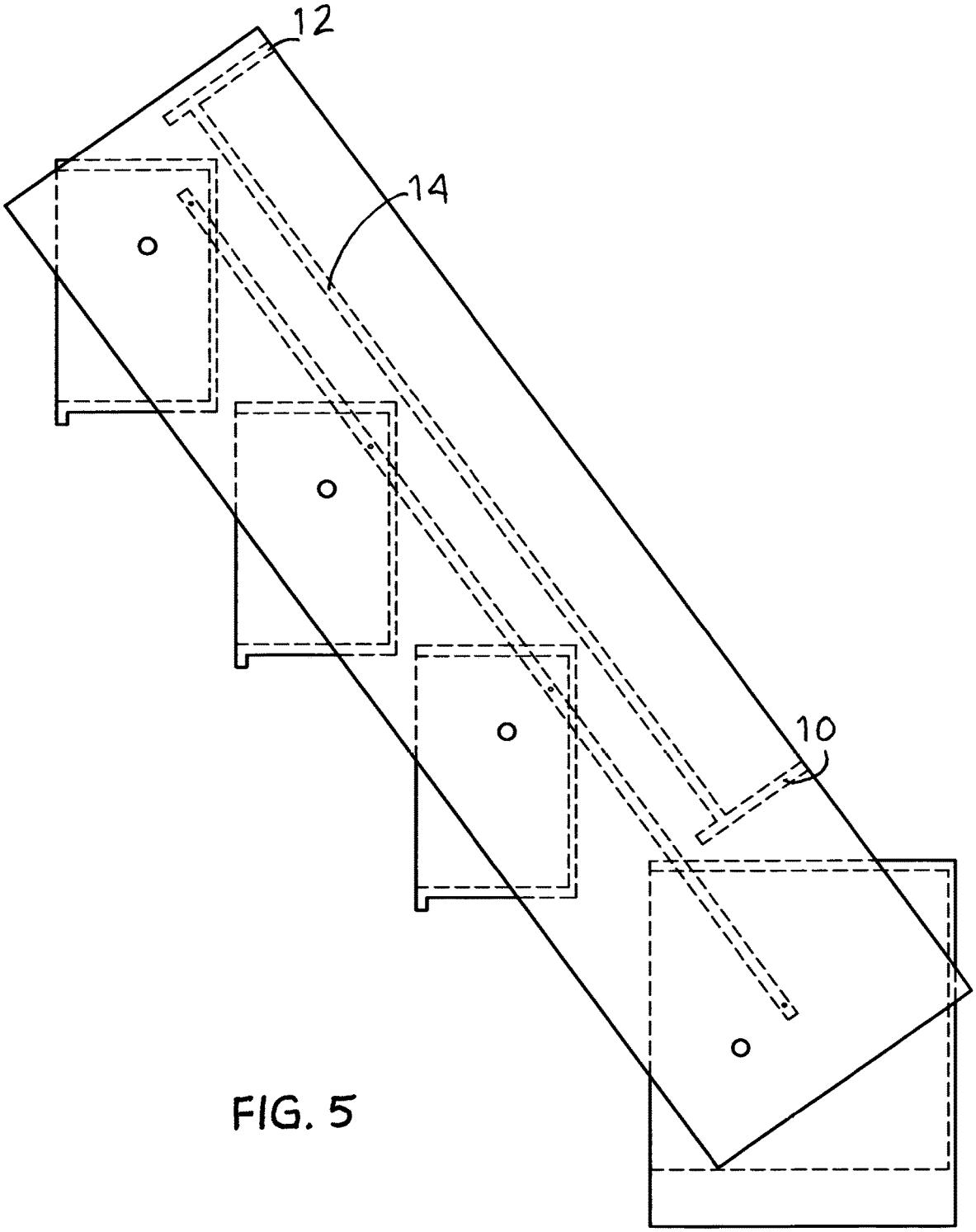

FIG. 5 profile in-motion view of FIG. 4 revealing hidden edges.

Figure 6:
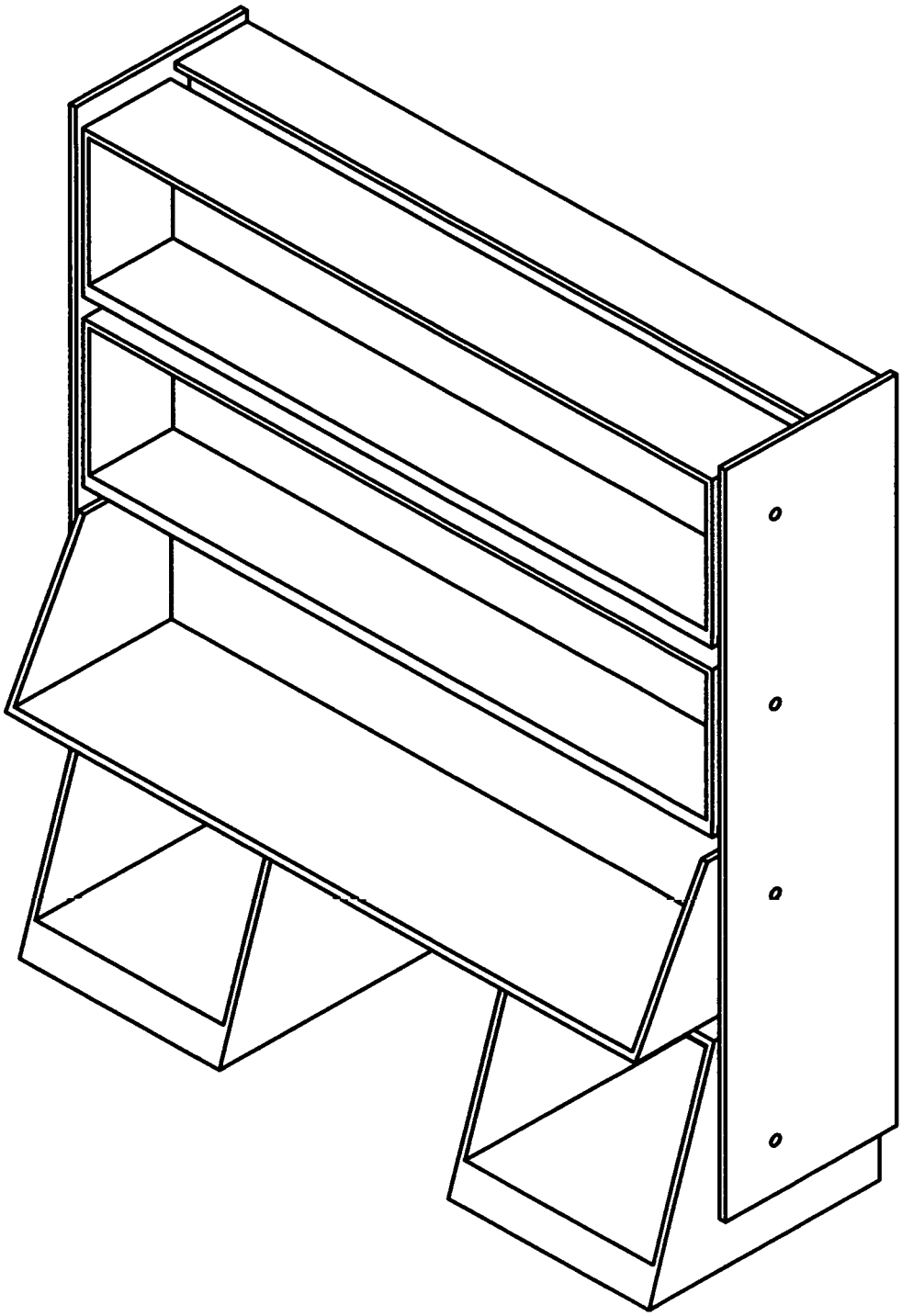

FIG. 6 isometric view of large bed design with 2 upper cabinet modules, desktop module, extended knee hole base.

Figure 7:
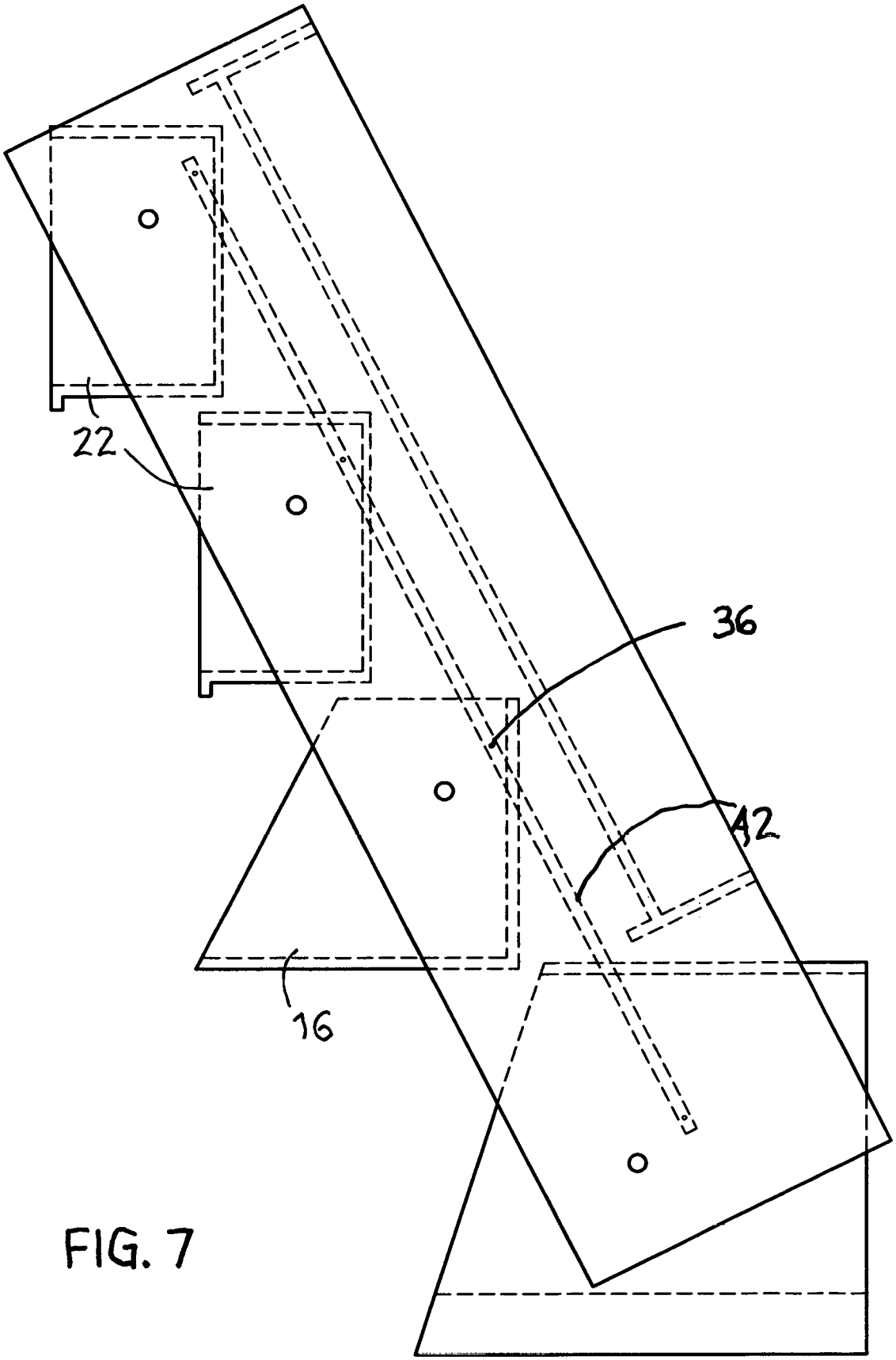

FIG. 7 profile in-motion view of FIG. 6 revealing hidden edges.

Figure 8:
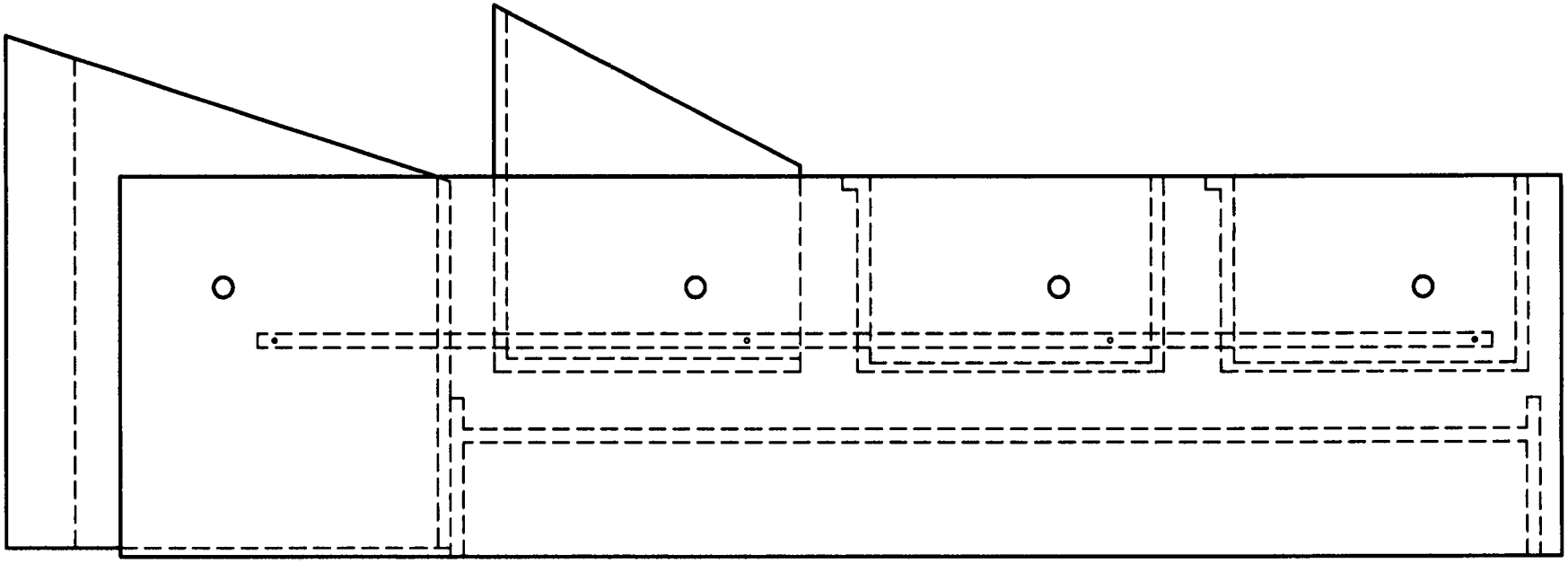

FIG. 8 profile vertical view of FIG. 6 revealing hidden edges.

Figure 9:
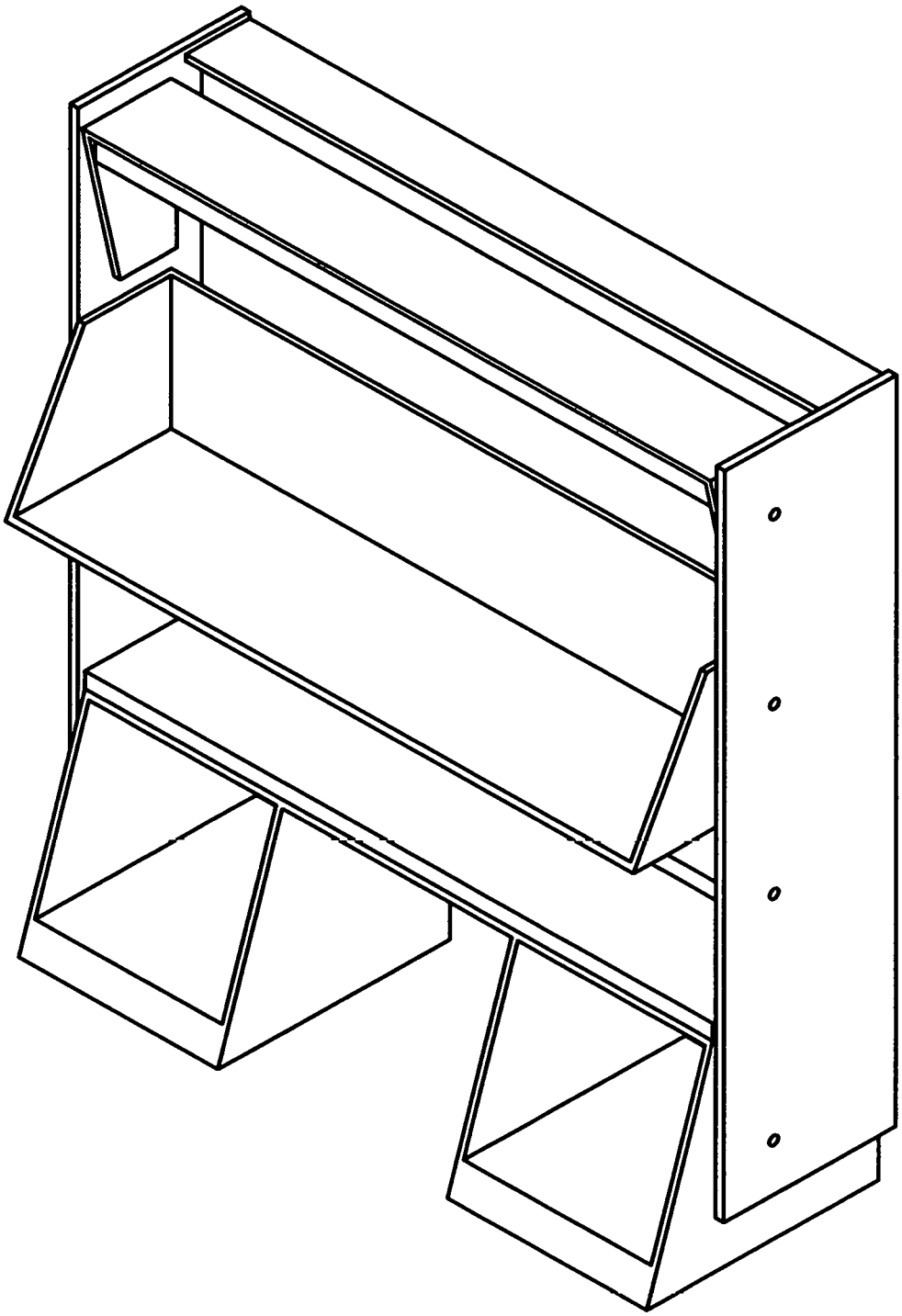

FIG. 9 isometric view of large bed design with valance type leg module, desktop module at standing height, extended knee hole base.

Figure 10:
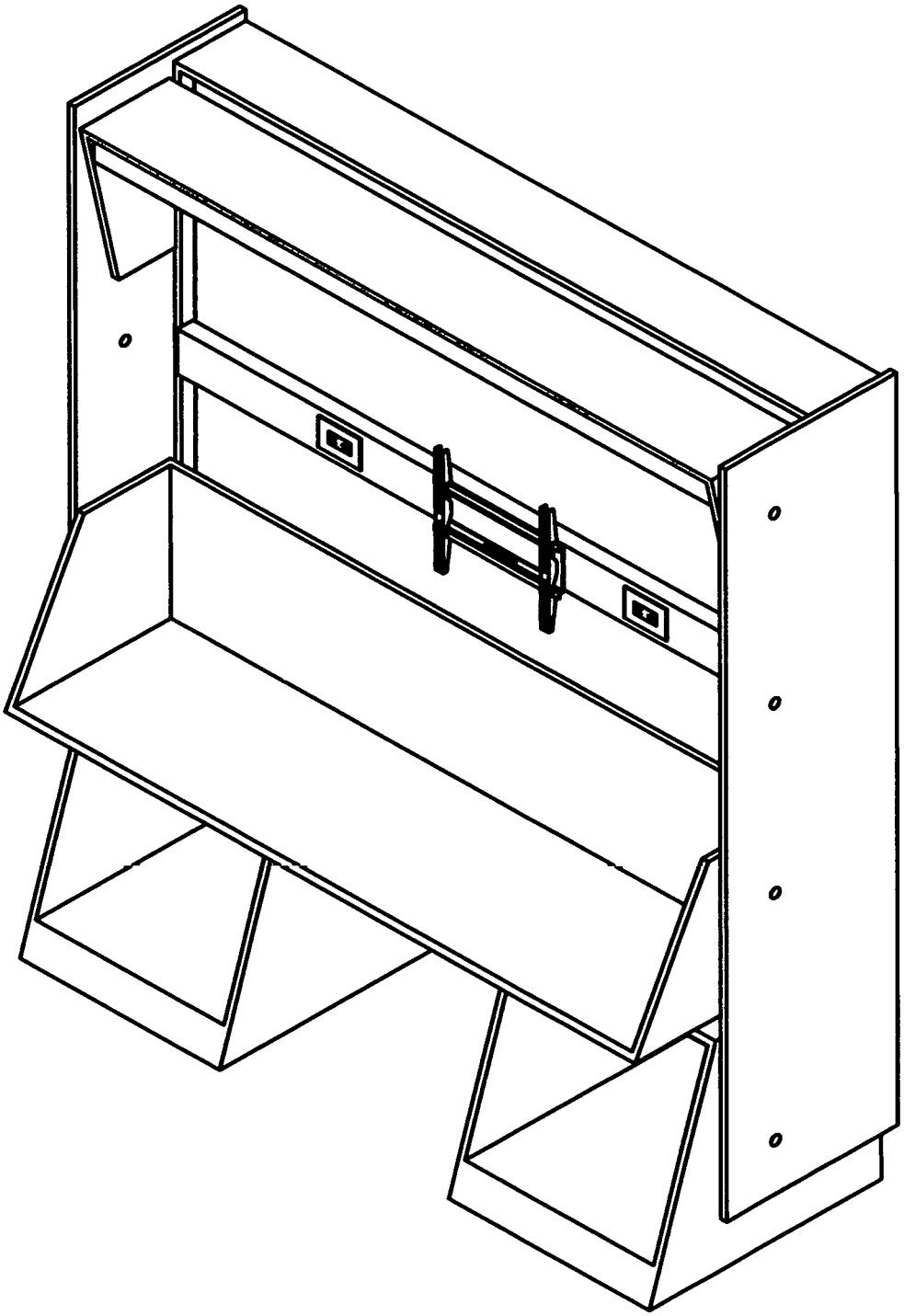

FIG. 10 isometric view of large bed design with valance type leg module, desktop module, extended knee hole base, outlet support bar with monitor/tv mount.

Figure 11:
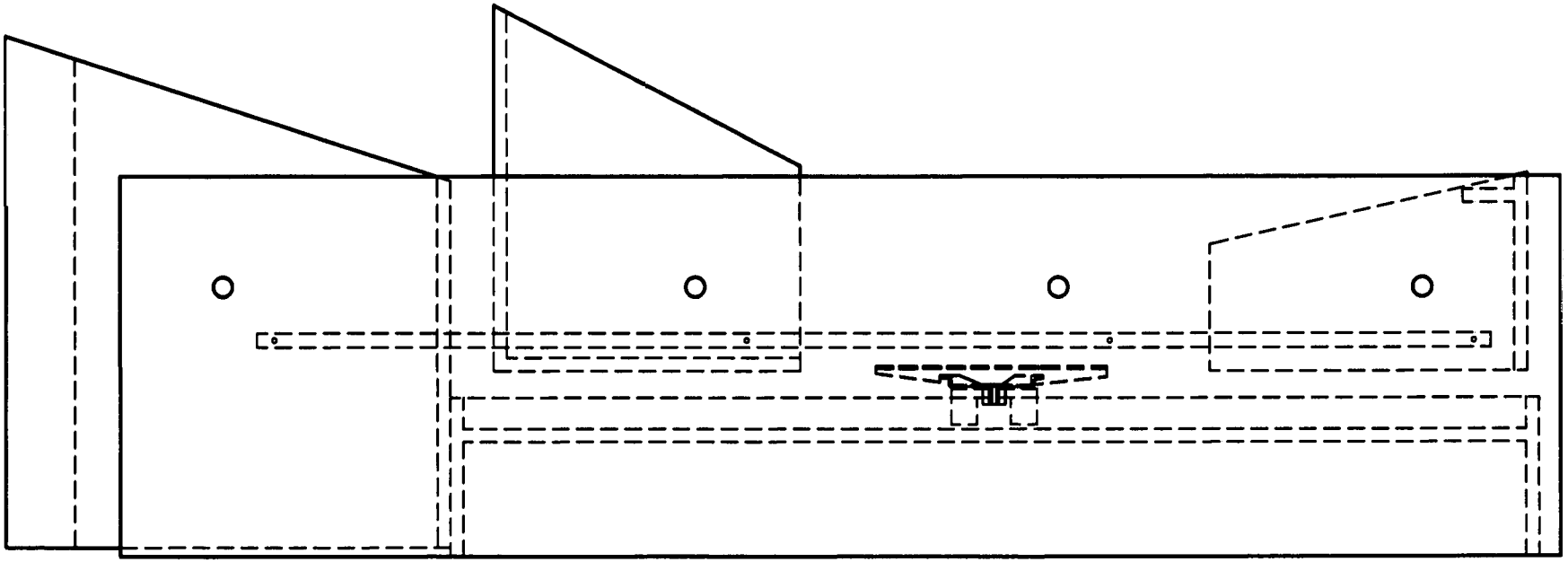

FIG. 11 profile vertical view of FIG. 10 revealing hidden edges.

Figure 12:
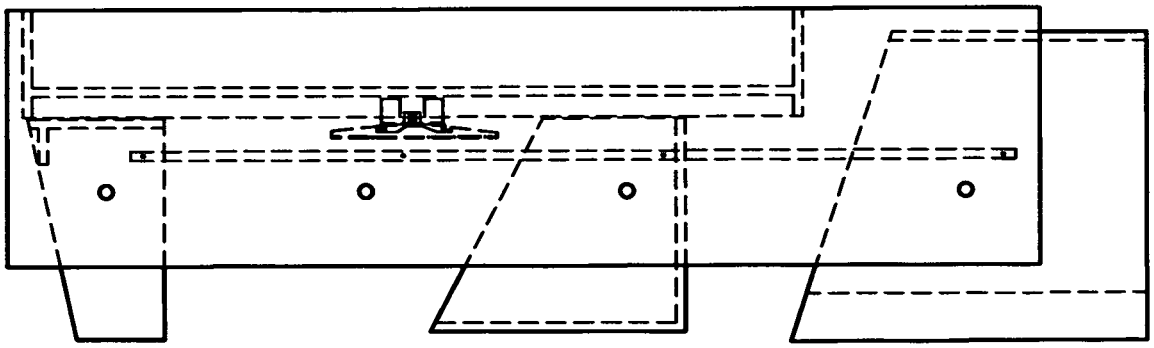

FIG. 12 profile horizontal view of FIG. 10 revealing hidden edges.

Figure 13B:
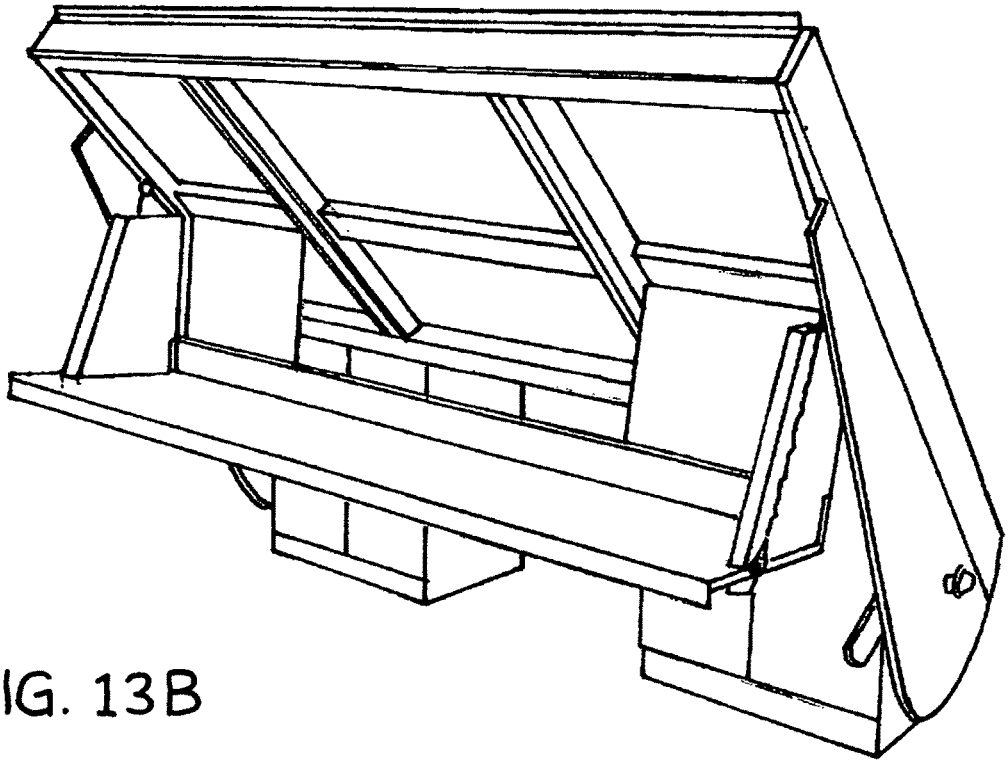
Figure 13A:
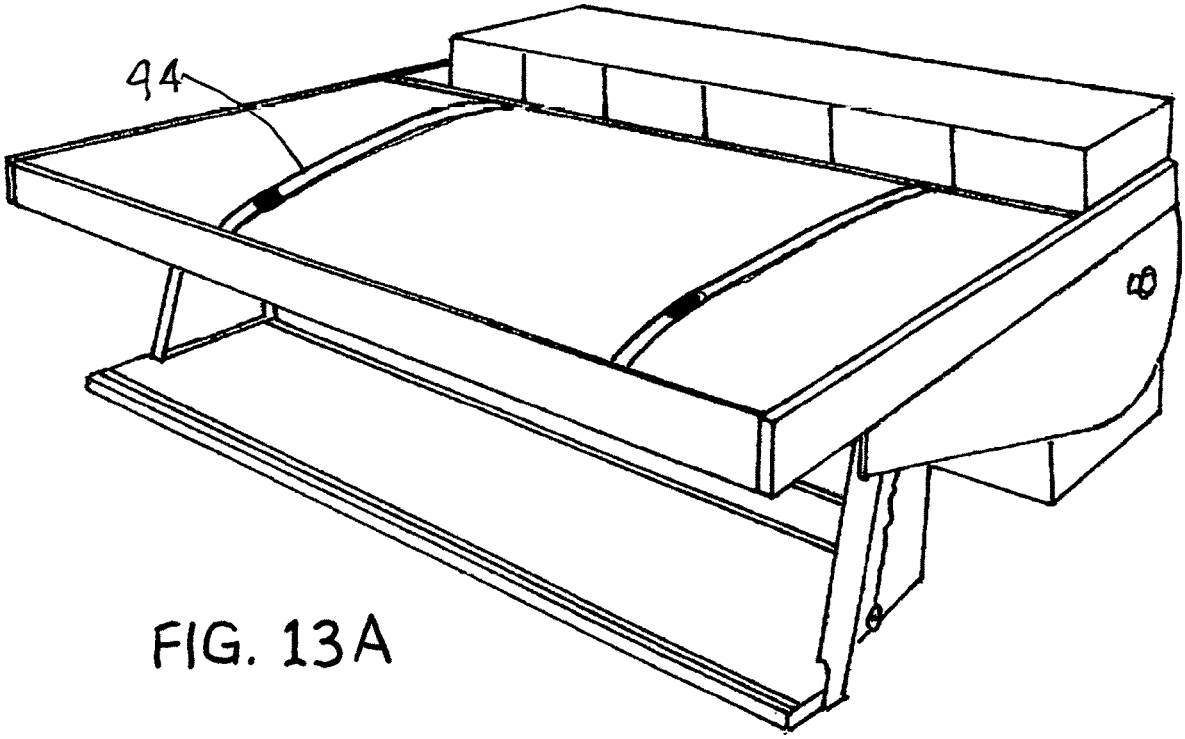

FIG. 13A perspective horizontal view of original desk/bed design.

FIG. 13B perspective view of original desk/bed design in motion.

FIG. 14A perspective profile view of original desk/bed design.

FIG. 14B perspective profile view of original desk/bed design in motion.

Figure 15B:
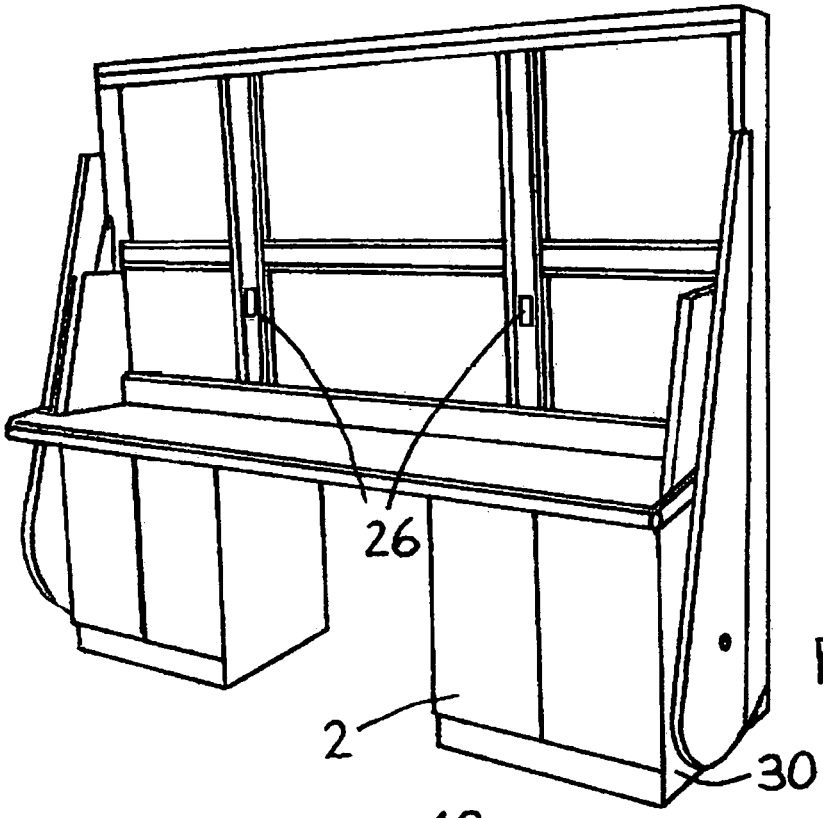
Figure 15A:
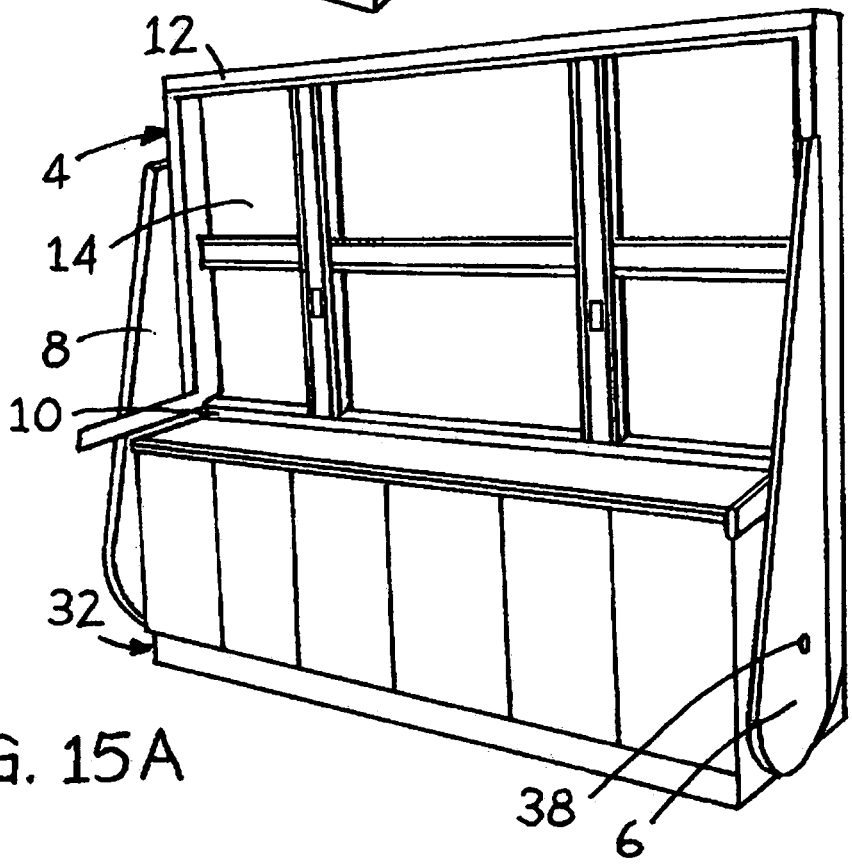

FIG. 15A perspective vertical view of hidden bed design without desktop.

FIG. 15B perspective vertical view of hidden bed design with desktop and knee hole base.

DRAWINGS—REFERENCE NUMERALS

| | | | |
|---|---|---|---|
| 2 | base cabinet | 4 | bedstead |
| 6 | left swingarm | 8 | right swingarm |
| 10 | interior rail | 12 | exterior rail |
| 14 | bed support panel | 16 | desktop module |
| 18 | leg/valance module | 20 | shelf module |
| 22 | upper cabinet module | 24 | outlet support bar |
| 26 | electric outlet | 28 | monitor/tv mount |
| 30 | base left end | 32 | base right end |
| 34 | modular pivot | 36 | modular linkage pivot |
| 38 | base pivot | 40 | base linkage pivot |
| 42 | linkage | 44 | webbing |
| 46 | cable | 48 | power cord |
| 50 | desktop | 52 | underside |

DETAILED DESCRIPTION

The present disclosure provides a bed frame that can lever off of the sides of a floor cabinet, clear the front edge of that cabinet, and land squarely on top of that cabinet. In one embodiment, a full-size version would fit inside of a 7' cube.

In one embodiment, a base 2 is provided. The present embodiment includes a desk and a base. As such, the base 2 height is a couple inches shorter than a normal adult desk. This would allow for the thickness of the desktop 50. The length of the base 2 will also vary depending on the size of the bed. The desktop 50 is not necessary in all embodiments. The height and depth of the base 2 and other dimensions can vary depending on the builder's end goal. If a child-size desk is preferred, the base 2 would be smaller. This would also lower the overall height of the extended, horizontal bedstead 4 and modules. The base 2 is to be comprised with a left end 30 and a right end 32 connected together and held vertical and plumb by a framework or plurality of panels of sufficient length to create storage or other purposes. A kneehole should be included unless the desktop is going to be mounted or configured at a standing height. Doors may also be desirable.

Pivotally attached to the base 2 is the bedstead 4. The bedstead 4 is comprised of an interior rail 10, an exterior rail 12, a left swingarm 6, a right swingarm 8, a bed support panel 14, and webbing 44 or other means to retain the bed and bedding in place when apparatus is in its horizontal position. The left swingarm 6 is connected to the right swingarm 8 by an interior rail 10, and an exterior rail 12 which form a rectangular frame that receives the bed support panel 14. The interior rail 10 and exterior rail 12 are to be of sufficient width to house the bed on the top, and, on the underside 52, have sufficient space for a support framework, and electrical outlets 26 and their components. This underside 52 space is also necessary, in another embodiment, for the rear of the modules to swing during rotation. These five items, 6, 8, 10, 12, and 14, will be of sufficient size to form a framed compartment where the bed resides. The left swingarm 6 and the right swingarm 8 are overreaching boards which extend beyond the beds framed compartment over to and reach alongside each end of the base 2 and are pivotally attached to the base's corresponding left end 30 and right end 32 at the base pivots 38. Now the bedstead 4 can rotate down from its vertical and plumb, resting position atop the base 2 to its horizontal and level, extended position in front of the base 2. The base 2 is the fulcrum. The bedstead 4 is the lever.

To make it multifunctional, self-leveling components are included. In one embodiment, an L-shaped desktop 50 is hinged to the bottom of the bedstead 4. This top had a left and a right end with a frontal post of sufficient length which, when rotated with the top, would line up under and support the corresponding left and right swingarms and limit the bedstead's downward rotation. A length of cable 46 is attached to one side of the desktop near the front edge. The cable is run through a pulley in front of the hinges then through another eyehook near the end of the interior rail. An anchor point is included on the floor cabinet, above and behind the cabinet pivot. The length of cable and the anchor point are selected to coincide.

In another embodiment, swinging components, or modules, suspended between the swingarms, and held level by tie-rods are provided.

In such an embodiment, the swingarms are made wider and capable of suspending the new modules adjacent to and parallel to the underside 52 of the bed compartment. The base pivots 38 remain in the same position, and the new modular pivots 34 are located in line with the base pivots 38 and parallel to the bed support panel 14 in both the horizontal and the vertical positions. The bed support panel 14 is positioned as it was in the previous embodiment. A linkage rod 42 is pivotally attached to each end of the base 2 at base linkage pivots 40 as well as to each module at modular linkage pivots 36. This linkage 42 follows along the inside of the swingarms and along the structure under the bed support panel 14, but not so close to the bed support panel 14 and its corresponding structure as to interfere with the linkage's 42 rotation.

A leg module 18 is the uppermost module and is necessary to limit the bedstead's downward rotation and provide support for the bedstead 4 in its horizontal position. The leg module has a right and a left end panel connected to each other by a framework or at least one panel. A light valance could be added to this module. An upper cabinet module 22 would also function here. Some necessary dimensions can be obtained while the bedstead 4 is in its horizontal and level position. In this position the height of the uppermost/outermost module will need to fill the gap between the floor and, in this case, the exterior rail 12. The plumb line created by the front of my original base cabinet 2 can be used that to determine the front of the upper modules. Thus, the rotation of the uppermost cabinet created its own axis or modular pivot 34 point where it will be pivotally attached on the swingarms 6,8.

The linkage 42 is pivotally attached to base 2 at base linkage pivot 40 point and uppermost module at modular linkage pivot 36 point. These linkage pivot points are at a stable and unobtrusive location about half way in between the modular pivots 34 and the bed support panel 14 structure. These points are equally distanced above and rearward of the main axis pivots forming a parallelogram. These points will also work if they are equally distanced below and frontward of the main pivots.

Other possible modules would include the aforementioned upper cabinet module 22. This could be a basic box such as a bookcase. This module has a right end and a left end equipped with modular pivots and linkage pivots, just like every module. A top, rear, and back panel are generally needed. A face frame and doors are nice options and a narrow apron hinged to the bottom of each that collapsed away when the bedstead 4 is horizontally extended.

The shelf, a bottom panel with a short back and module ends, as previously described, could be used for a unit where the user wanted a more open underside 52 affixed with a monitor/tv mount 28 or other visuals such as art.

Another module, and a popular one, would be the desktop module 16. It would need the module ends, as previously described, a deeper bottom panel and a back.

If desired, other modules can be added in between the base and the uppermost module. Their size should be slightly smaller than the uppermost module so they do not contact the floor. In the case of a smaller sized bedstead 4, one more similar-sized module is possible. A larger sized bedstead can support a total of three. The length of the modules will depend on the distance between the swingarms. One can also add electrical outlets 26 in an outlet bar 24 to the underside 52 of the bedstead. The power cord 48 would be attached to the swingarm and exit near the wall.

Operation

The bedstead is at rest when in its upright position. As it rotates down to its extended position, the bed is revealed. The modules rotation in between the swingarms keeps them level and carries their content undisturbed to the floor and underneath bed. As it rotates down the load is dampened by a tensioning means to gain a mechanical advantage. The related art section offered a variety of ways to deal with counterbalance, any of which would work with the present apparatus. A spring system in between the base cabinet and the swingarm is provided in one embodiment. An actuator is provided in another embodiment.

Alternative Embodiments

Various alternatives and can be seen in the drawings. The base cabinet can be of various sizes and dimensions. It can have a knee hole in order to accommodate a desk. The foot of the cabinet can extend frontward giving it the ability to be freestanding or on casters.

The upper section can basically transform into whatever is desired out of a cabinet. Elsewise, one could decrease the modules and adorn the underside with art, a television, an interactive whiteboard, or a video gaming center.

Linking these units end-to-end could be done in a barracks or other similar environment.

Wood products could be used when building such furniture. Tin, steel, aluminum, or other metallic alloys could also be used. Various plastics, vinyl, and other rigid products might also be considered. Canvas, or other fabric, stretched across a frame could also be used in places.

Advantages

The present hidden bed design has several advantages over previously created designs. Undisturbed storage is provided by the base cabinets. The base cabinets provides for drawer space, plain shelving or concealing old radiators or other eyesores or obstructions.

It also conserves space by taking up a small footprint. Its efficient use of floor space could be very useful in dormitories and professor's offices; military posts and prisons; factories, manufacturing and technology centers and start-ups; children's rooms; spare walk-in closets; just about anywhere that people need to work and live in small spaces.

The versatility of its modular design and self-leveling components are also great assets. The presently disclosed devices could potentially surround an entire room.

The hidden beds described could encompass an entertainment center, a desk; a bookcase or two; a display cabinet; a wardrobe; a pantry; and a guncase to name a few.

CONCLUSION, RAMIFICATIONS AND SCOPE

All of the wallbed designers that have been listed previously, and the present disclosure, builds a bed that was hidden when not in use, and that wasn not a pain to stow away. The present device adds superior versatility to the previous designs. It is superior in storage, utility and function to all previously conceived products of this type.

I, the applicant, claim as new:

1. A combination furniture construction comprising a bed frame, movable between a vertical and horizontal position, in which the bed frame has a right end and a left end endowed with overreaching boards, hereafter referred to as swingarms, of sufficient length to pivotally attach to a corresponding right end and a corresponding left end of a floor structure;

said bed frame which includes a right swingarm and a left swingarm connected by a plurality of panels including an interior rail and an exterior rail with a bed support panel surrounded within;

said floor structure which includes a right wall and a left wall connected by a plurality of horizontal panels including a topmost panel of sufficient size to support the bed frame in a first upright mode;

said topmost panel connecting said right wall's top edge with said left wall's top edge;

said right wall including an external right base pivot horizontally aligned along a common axis with an external left base pivot on said left wall;

said right base pivot supporting the right swingarm in the first upright mode; said left base pivot supporting the left swingarm in the first upright mode;

a damping means functioning to counter a force of gravity acting downward on the bed frame during a transition from the first upright mode to a second bed mode wherein a mattress support is revealed;

said bed frame disposed forwardly adjacent to said floor structure in the second bed mode; a useable structure functioning to provide support for the bed frame when said bed frame extends to a level position in the second bed mode, wherein said useable structures, hereafter referred to as modules, are of sufficient length and are suspended in between said swingarms and adjacent to said underside by way of modular pivots;

said modules which include a right end connected to a left end by at least one panel;

said modular pivots including a right modular pivot which shares a common axis with a left modular pivot at respective ends of said modules;

said modular pivots positioned substantially toward a center, vertically and laterally, on said module ends in the first upright mode and in the second bed mode and vertically aligned with the base pivots in the first upright mode;

said modular pivots are further positioned level with base pivots in second bed mode; said modular pivots connecting said modules at predetermined points on said swingarms wherein the modules swivel into a position underneath the bed frame in the downward transition to the second bed mode.

2. A combination furniture construction as per claim 1, wherein said bed frame, when rotated upward on the base pivots, comes to rest vertically on top of said floor structure unveiling an underside of said bed frame;

said underside providing a mounting surface for useful components selected from the group a consisting of corkboards, whiteboards, chalkboards, mirrors, artwork, TVs, monitors, and electrical outlets.

3. A combination furniture construction as per claim 2, wherein said floor structure includes at least one cabinet.

4. A combination furniture construction as per claim 2, wherein one or more modules are selected from the group consisting of shelves, legs, valances, bookcases, cabinets, and desktops and have a linkage that connects the modules to each other and said floor structure;

said floor structure walls having base linkage pivots mounted upward and rearward of said base pivots;

said module ends having modular linkage pivots mounted upward and rearward of said modular pivots;

said floor structure's base linkage pivots at a distance rearward of said base pivots equal to the rearward distance between the modular linkage pivots and the modular pivots;

said floor structure's base linkage pivots at a distance upward of said base pivots equal to the upward distance between the modular linkage pivots and the modular pivots;

said linkage having an adequate length to connect said base linkage pivots with the respective modular linkage pivots on each module.

5. A combination furniture construction as per claim 4, wherein said floor structure includes at least one cabinet.

6. A combination furniture construction as per claim 1, wherein said floor structure includes at least one cabinet.

* * * * *